US008342874B2

(12) United States Patent
Zhu

(10) Patent No.: US 8,342,874 B2
(45) Date of Patent: Jan. 1, 2013

(54) ELECTRICAL CONNECTOR WITH IMPROVED LOCKING MEMBER HAVING LATCH STRUCTURE THEREOF

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/171,487

(22) Filed: Jun. 29, 2011

(65) Prior Publication Data

US 2012/0178277 A1 Jul. 12, 2012

(30) Foreign Application Priority Data

Jan. 6, 2011 (CN) ..... 2011 2 0002558

(51) Int. Cl.
*H01R 13/627* (2006.01)

(52) U.S. Cl. ..... 439/357

(58) Field of Classification Search ..... 439/357, 439/350, 353, 74, 347, 345
See application file for complete search history.

(56) References Cited

U.S. PATENT DOCUMENTS 3,842,395 A * 10/1974 Tucker ..... 439/347
5,120,256 A * 6/1992 Walden ..... 439/553
5,224,866 A * 7/1993 Nakamura et al. ..... 439/81
5,395,265 A * 3/1995 DiMondi et al. ..... 439/553
5,464,355 A * 11/1995 Rothenberger ..... 439/559
5,626,482 A * 5/1997 Chan et al. ..... 439/74
5,928,003 A * 7/1999 Kajinuma ..... 439/74
5,931,689 A * 8/1999 Patel ..... 439/346
6,095,824 A * 8/2000 McHugh ..... 439/74
6,250,935 B1 * 6/2001 Mochizuki et al. ..... 439/74
6,645,005 B2 * 11/2003 Wu ..... 439/563
6,666,706 B1 * 12/2003 Jones et al. ..... 439/405
6,702,590 B2 * 3/2004 Zaderej et al. ..... 439/74
6,805,571 B2 * 10/2004 Huang ..... 439/330
6,926,539 B2 * 8/2005 Zaderej et al. ..... 439/74
6,986,670 B2 * 1/2006 Okura et al. ..... 439/74
7,037,117 B2 * 5/2006 Goto ..... 439/74
7,044,765 B1 * 5/2006 Lee et al. ..... 439/354
7,090,508 B1 * 8/2006 Chen ..... 439/74
7,172,434 B2 * 2/2007 Obikane et al. ..... 439/74
7,182,608 B2 * 2/2007 Soh et al. ..... 439/74
7,247,029 B2 * 7/2007 Chen ..... 439/66
7,320,605 B2 * 1/2008 Chang et al. ..... 439/74
7,354,279 B2 * 4/2008 Uesaka ..... 439/74
7,384,274 B1 * 6/2008 Chen et al. ..... 439/74
7,458,822 B2 * 12/2008 Ono ..... 439/74
7,513,780 B2 * 4/2009 Dahms et al. ..... 439/65
7,553,168 B2 * 6/2009 Zhu et al. ..... 439/74
(Continued)

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector assembly includes a first and second connector and locking members. The first connector defines a mating surface and two rows of first terminals along a lateral direction. Each row is arranged along a longitudinal direction. The first terminals include elastic contacting portions projecting beyond the mating surface. The second connector defines a receiving space to receive said first connector and includes two rows of second terminals. The locking members are formed in a same shape and each comprises a retention portion and a latch portion. The first and the second connectors define at least one receiving slot between two rows of passageways and extending in the longitudinal direction, the locking members are retained in the receiving slots respectively, the locking member located in the first connector is hid in the slot and the locking member located in the second connector projecting perpendicularly beyond the bottom surface.

12 Claims, 4 Drawing Sheets

U.S. PATENT DOCUMENTS

| | | | | |
|---|---|---|---|---|
| 7,588,443 | B2 * | 9/2009 | Wu et al. | 439/74 |
| 7,658,658 | B2 * | 2/2010 | Zhu | 439/862 |
| 7,736,177 | B2 * | 6/2010 | Tsai | 439/570 |
| 7,748,994 | B1 * | 7/2010 | Peng et al. | 439/74 |
| 7,828,559 | B2 * | 11/2010 | Chen et al. | 439/74 |
| 7,922,499 | B2 * | 4/2011 | Liao | 439/74 |
| 7,963,810 | B1 * | 6/2011 | Yang | 439/686 |
| 8,052,478 | B2 * | 11/2011 | Zhu | 439/660 |
| 8,083,527 | B2 * | 12/2011 | Takeuchi et al. | 439/65 |
| 8,172,623 | B1 * | 5/2012 | Zhu | 439/709 |
| 8,192,217 | B2 * | 6/2012 | Zhu | 439/284 |
| 2011/0065299 | A1 * | 3/2011 | Zhu | 439/190 |
| 2011/0294351 | A1 * | 12/2011 | Zhu | 439/638 |
| 2012/0052741 | A1 * | 3/2012 | Zhu | 439/660 |
| 2012/0122332 | A1 * | 5/2012 | Zhu | 439/345 |

* cited by examiner

ELECTRICAL CONNECTOR WITH IMPROVED LOCKING MEMBER HAVING LATCH STRUCTURE THEREOF

FIELD OF THE INVENTION

The present invention generally relates to an electrical connector, and more particularly to an electrical connector with a pair of locking members having latches thereof.

DESCRIPTION OF PRIOR ART

Conventionally, an electrical connector comprises an insulative housing and a number of terminals received in the insulative housing and a pair of board locks secured at two sides of the housing for mounting the electrical connector onto a printed circuit board (PCB). Each board lock comprises a latch portion formed at a tip thereof for connecting the electrical connecter with a mating connector. However, the engagement between the electrical connector and the mating connector is not reliable.

Hence, an improved electrical connector is highly desired to overcome the aforementioned problems.

SUMMARY OF THE INVENTION

The present invention provides an electrical connector assembly comprising a first connector and a second connector mate with the first connector and locking members. The first connector defines a mating surface and comprises two rows of first terminals along a lateral direction. Each row is arranged along a longitudinal direction perpendicular to the lateral direction. The first terminals comprise elastic contacting portions projecting beyond the mating surface. The second connector defines a receiving space intending to receive said first connector and comprises two rows of second terminals intending to contact with corresponding first terminals respectively. The second terminals comprise plate contacting portions exposing to a bottom surface of the receiving space thereof. The locking members are formed in a same shape and each comprises a retention portion and a latch portion. The first and the second connectors define at least one receiving slot between two rows of passageway and extending in the longitudinal direction, the locking members are retained in the receiving slots respectively, the locking member located in the first connector is hid in the at least one slot and the locking member located in the second connector projecting perpendicularly beyond the bottom surface of the receiving space.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
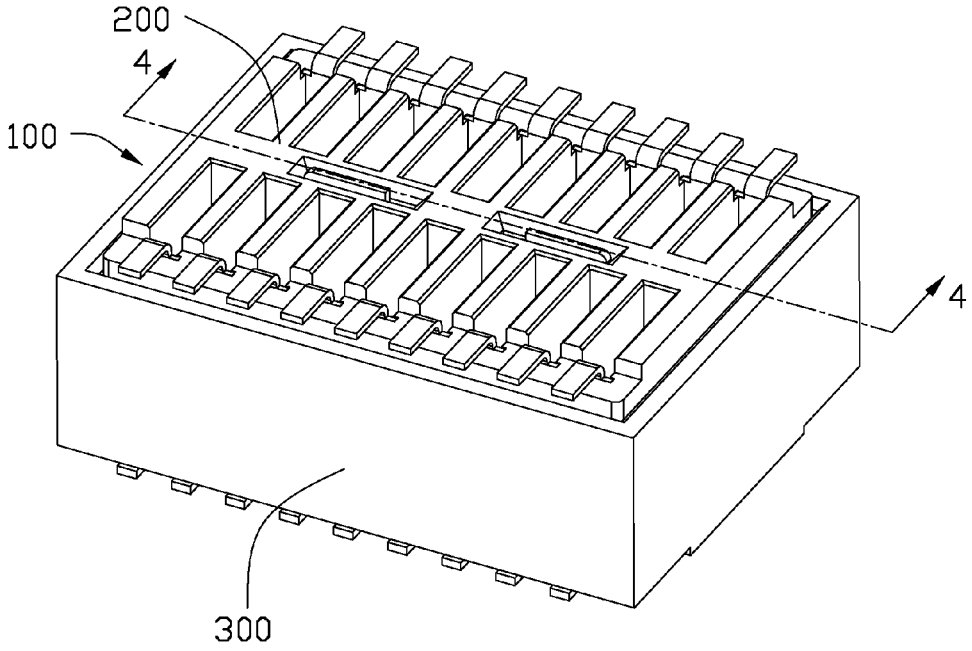
FIG. 1 is a perspective view of an electrical connector assembly of an embodiment of the present invention.

Referring to FIG. 1, an electrical connector assembly 100 in accordance with the present invention adapted for connecting two printed circuit boards (PCB), comprises an electrical connector 200 and a mating connector 300 adapted to engage with the electrical connector 200.

Figure 2:
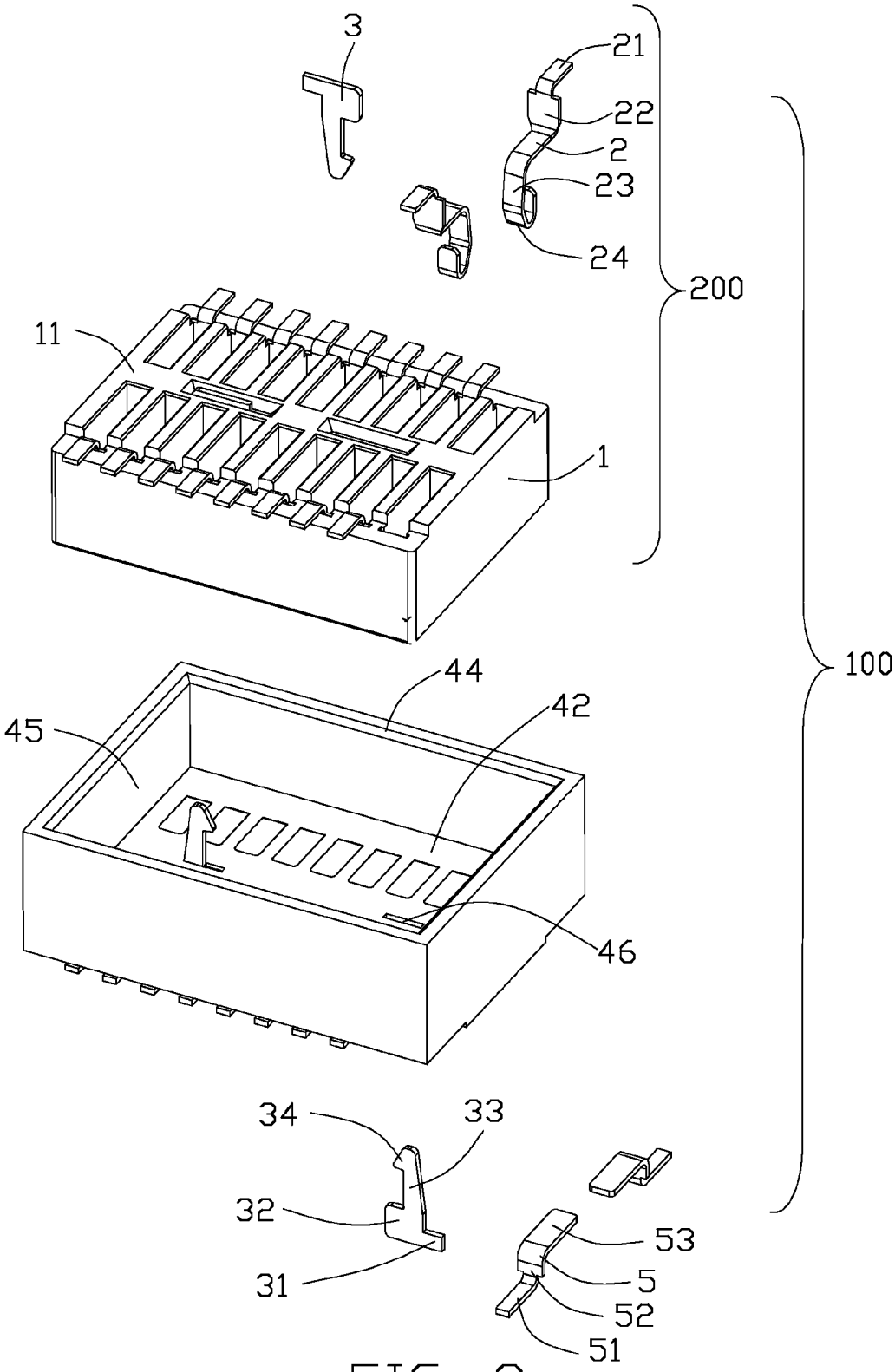
FIG. 2 is an exploded, perspective view of FIG. 1.
Figure 3:
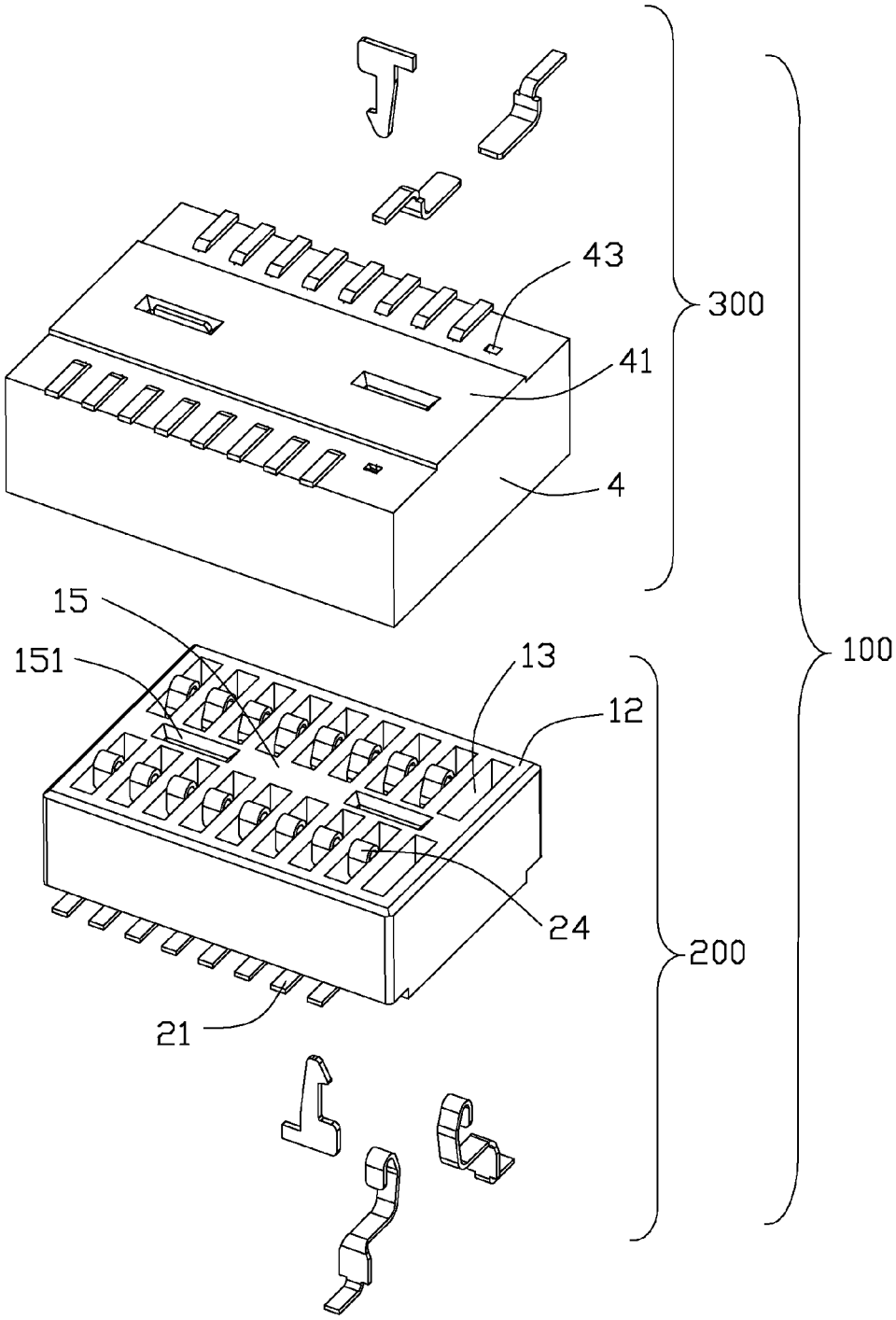
FIG. 3 is another exploded, perspective view of FIG. 1, viewed from another aspect.

Referring to FIGS. 2 and 3, the electrical connector 200 comprises an elongated insulative housing 1, a plurality of terminals 2 and two first locking members 3 retained in the insulative housing 1. The insulative housing 1 defines a mounting surface 11 abutting against one PCB, a mating surface 12 opposite to the mounting surface 11 and two rows of passageways 13 penetrating through the mounting surface 11 and the mating surface 12. The terminals 2 are assembled to the corresponding passageways 13 from the mounting surface 11 of the insulative housing 1. Each terminal 2 comprises a retention portion 22, a soldering portion 21 bent form one end of the retention portion 22, a resilient portion 23 extending from the other end of the retention portion 22 and an elastic contact portion 24 extending from the resilient portion 23. The contact portion 24 is configured as a curved shape and projects beyond the mating surface 12.

The mating connector 300 comprises an insulated housing 4, a plurality of mating terminals 5 and two second locking members 3 retained in the insulated housing 4. The insulated housing 4 defines a mounting surface 41 abutting against the other PCB, a mating surface 42 opposite to the mounting surface 41 and a receiving space 45 surrounded by a peripheral wall 44 projecting from an edge of the mating surface 42. Two rows of passageways 43 run through the mounting surface 41 and communicate with the receiving space 45. Each mating terminal 5 comprises a soldering section 51 located in the mounting surface 41, a mating section 53 exposing in the mating surface 42 and a connection section 52 connecting the soldering section 51 with the mating section 53. The mating terminals 5 are fixed to the corresponding passageways 43 by insert molding. The mating section 53 is configured as a plate shape. When the electrical connector 200 and the mating connector 300 mate with each other, the contact portions 24 are elastically abut against the mating sections 53. Thus, an electrical connection is formed.

Figure 4:
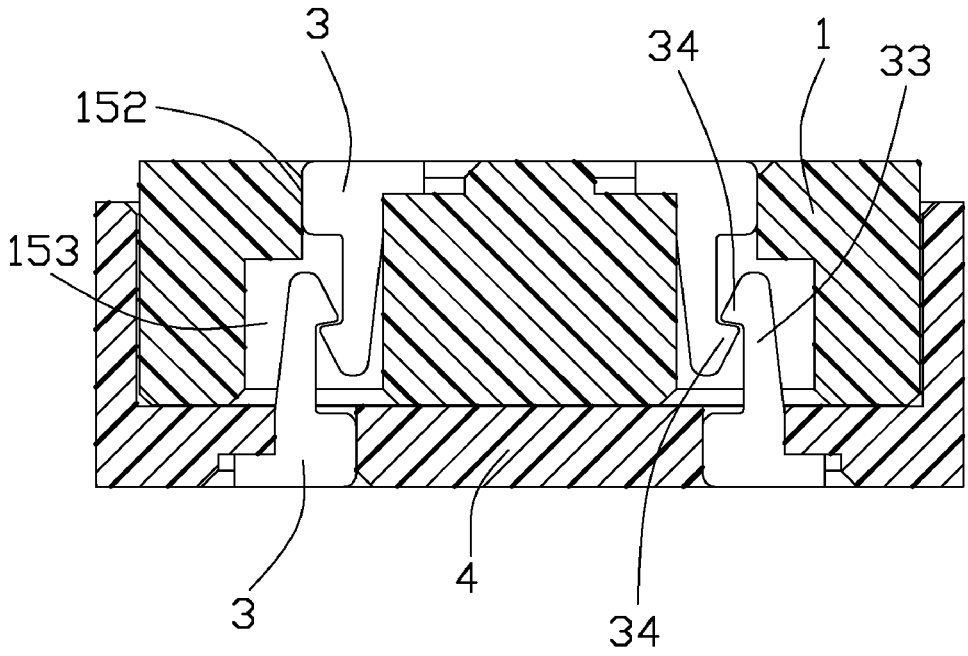
FIG. 4 is a cross-sectional view of the electrical connector assembly in FIG. 1.

The two rows of passageways 13 are arranged along a lateral direction and spaced from each other at a specified distance so that a partition wall 15 is formed between the two rows of passageways. The passageways 13 of each row are arranged along a longitudinal direction perpendicular to said lateral direction. The terminals 2 are assembled to the corresponding passageways 13 from the mounting surface 11 of the insulative housing 1 and symmetric to the partition wall 15. A pair of receiving slots 151 is defined in the partition wall 15 and penetrates through the mating surface 12 and the mounting surface 11. Furthermore, the two receiving slots 151 are arranged and extending along the longitudinal direction. Combination with FIG. 4, each receiving slots 151 comprises a first section 152 and a second section 153 which is wider than the first section 152. The two first locking members 3 are assembled to the receiving slots 151 from the mounting surface 11. Each locking member 3 comprises a mounting portion 31 for retaining with the PCB, a retention portion 32 retained in the first section 152 of the receiving slots 151, an elastic portion 33 extending from an upper end of the retention portion 32 and a latch portion 34 formed at a tip of the elastic portion 33. The retention portions 32 of the locking members 3 interfere with internal walls of the first section 152 of the receiving slots 151. The elastic portion 33 of the locking member 3 are received in the second sections 153 of the receiving slots 151 and do not extend beyond the mating surface 12.

A pair of positioning slots 46 adapted for securing the two locking members 3 is located between the two rows of passageways 43 and penetrates through the mating surface 42 and the mounting surface 41. The two positioning slots 46 are arranged along the longitudinal direction so as to align with the two receiving slots 151. The two second locking members 3 are assembled to the positioning slots 46 from the mounting surface 41. The shape of the second locking member 3 is same to the shape of the first locking member 3. The second locking member 3 comprises an elastic portion 33 extending beyond the mating surface 42 and received in the receiving space 45. When the two connectors 200, 300 mate with each other, the insulative housing 1 is inserted into the receiving space 45. In the meantime, the contact portions 24 of the terminals 2 elastically abut against the mating sections 52 of the mating terminals 5 and the first and second locking members 3 engage with each other securely by the latch portions being locking with each other.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical connector assembly comprising:

a first connector defining a mating surface and comprising two rows of first terminals along a lateral direction and each row arranged along a longitudinal direction perpendicular to the lateral direction, the first terminals comprising elastic contacting portions projecting beyond the mating surface;

a second connector defining a receiving space intending to receive said first connector and comprising two rows of second terminals intending to contact with corresponding first terminals respectively, the second terminals comprising plate contacting portions exposing to a bottom surface of the receiving space thereof;

locking members formed in a same shape and each comprising a retention portion and a latch portion;

wherein the first and the second connectors define at least one receiving slot between two rows of passageways and extending in the longitudinal direction respectively, the locking members are retained in the receiving slots respectively, the locking member located in the first connector is hid in the at least one slot and the locking member located in the second connector projecting perpendicularly beyond the bottom surface of the receiving space.

2. The electrical connector assembly as recited in claim 1, wherein the at least one receiving slot of the first connector comprises a first section and a second section which is wider than the first section, the retention portion of the locking member interferes with internal walls of the first section, the elastic portion of the locking member is received in the second section of the receiving slot and do not extend beyond the mating surface.

3. An electrical connector, comprising:

an insulative housing defining opposite mating and mounting surfaces, two rows of passageways penetrating through the mating surface and a pair of receiving slots penetrates through the mating surface;

a plurality of terminals retained in the passageways, each terminal comprising a contacting portion extending beyond the mating surface; and a pair of locking member secured in the corresponding slots of the insulative housing;

wherein the pair of receiving slots are located between the two rows of passageways and arranged along a longitudinal direction along which each row of passageways are arranged;

wherein the two rows of passageways are separated by a partition wall extending along said longitudinal direction, said receiving slots are formed at the partition wall, and the pair of locking members are hidden in the corresponding receiving slots.

4. The electrical connector as recited in claim 3, wherein said locking members do not extend beyond the mating surface.

5. The electrical connector as recited in claim 4, wherein said receiving slots are separated from corresponding longitudinal ends of the partition wall.

6. The electrical connector as recited in claim 5, wherein each locking member comprises a mounting portion exposed to the mounting surface, a retention portion retained in the receiving slot, an elastic portion extending from an upper end of the retention portion and a latch portion formed at a tip of the elastic portion.

7. The electrical connector as recited in claim 6, wherein the two rows of passageways are symmetric to the partition wall.

8. An electrical connector assembly comprising:

a first connector including:

an insulative first housing defining a base with a plurality of side walls commonly defining a rectangular receiving cavity;

a plurality of first contacts disposed in the first housing; and a second connector including:

an insulative second housing defining a rectangular body adapted to be received in the receiving cavity;

a plurality of second contacts disposed in the second housing under condition that the first contacts and the second contacts contact with each other in a head-to-head manner to result in a reaction force to leave each other; and two pairs of locking members respectively located on the first connector and the second connector, wherein the pair of locking members of the first connector extend into corresponding slits formed in the second housing, where the pair of locking members of the second connector are already located therein so as to be locked to the pair of locking members of the first connector in a hidden manner for resisting said reaction force.

9. The electrical connector assembly as claimed in claim 8, wherein both said two pairs of locking members lies in a vertical plane which extends along a longitudinal direction of the first housing and the second housing.

10. The electrical connector assembly as claimed in claim 9, wherein the first contacts are arranged in two rows along the longitudinal direction, and the pair of locking members of the first connector are located between said two rows.

11. The electrical connector assembly as claimed in claim 9, wherein the second contacts are arranged in two rows along the longitudinal direction, and the pair of locking members of the second connector are located between said two rows.

12. The electrical connector assembly as claimed in claim 8, wherein each of the pair of the locking members defines a stepped structure to abut against the corresponding housing toward the other housing so as to assure no withdrawal between the two housings.

* * * * *